United States Patent [19]

Shiley et al.

[11] Patent Number: 4,888,029

[45] Date of Patent: Dec. 19, 1989

[54] DESULFURIZATION OF CARBONACEOUS MATERIALS

[75] Inventors: Richard H. Shiley, Sidney; Randall E. Hughes, Champaign, both of Ill.; John R. Webster, Bloomington, Ind.; Conrad C. Hinckley, Carbondale, Ill.; Gerald V. Smith, Carbondale, Ill.; Tomasz Wiltowski, Carbondale, Ill.

[73] Assignees: The Board of Trustees of Southern Illinois University, Carbondale; The Illinois State Geological Survey, Champaign, both of Ill.

[21] Appl. No.: 203,272

[22] Filed: Jun. 7, 1988

[51] Int. Cl.[4] ..... C10L 5/00; C10B 57/00

[52] U.S. Cl. ..... 44/622; 44/905; 201/17; 208/209; 208/214; 423/461

[58] Field of Search ..... 44/621, 622, 625, 905; 423/460, 461; 75/6; 208/209, 214; 201/17

[56] References Cited

U.S. PATENT DOCUMENTS

| | | | |
|---|---|---|---|
| 3,759,673 | 9/1973 | Whitten et al. | 44/1 R |
| 3,768,988 | 10/1973 | Meyers | 423/461 |
| 3,909,211 | 9/1975 | Diaz et al. | 44/625 |
| 3,909,212 | 9/1975 | Schroeder | 44/1 R |
| 3,909,213 | 9/1975 | Sanders | 201/17 |
| 4,030,893 | 6/1977 | Keller | 44/1 B |
| 4,045,092 | 8/1977 | Keller | 302/66 |
| 4,052,170 | 10/1977 | Yan | 201/17 |
| 4,055,400 | 10/1977 | Stambaugh et al. | 201/17 |
| 4,071,328 | 1/1978 | Sinke | 44/1 R |
| 4,146,366 | 3/1979 | Keller | 44/1 R |
| 4,192,651 | 3/1980 | Keller | 44/1 SR |
| 4,256,464 | 3/1981 | Ray | 44/625 |
| 4,324,559 | 4/1982 | Porter et al. | 44/1 SR |
| 4,325,802 | 4/1982 | Porter et al. | 208/10 |
| 4,391,609 | 7/1983 | Kalvinskas et al. | 44/625 |
| 4,451,351 | 5/1984 | Porter et al. | 208/10 |
| 4,678,478 | 7/1987 | Kelland | 44/1 SR |

OTHER PUBLICATIONS

Kor, G. J. W., Desulfurization and Sulfation of Coal and Coal Char. Coal Desulfurization Chemical and Physical Methods, T. D. Wheelock (Editor), A.C.S. Symposium Series, 64 (1977), Ch. 18, pp. 221-247.

Boodman, N. S. et al., Fluid Bed Carbonization/Desulfurization of Illinois Coal by the Clean Coke Process: PDU Studies, Coal Desulfurization Chemical and Physical Methods, A.C.S. Symposium Series, 64 (1977), Ch. 19, pp. 248-266.

Hughes, R. E. et al. (1987), Carbon Monoxide/Ethanol Desulfurization of Illinois High-Sulfur Coal, Illinois Coal Development Board Fourth Annual Contractors Technical Meeting, Urbana, Ill., Jul. 28-30.

Hughes et al. (1986), Desulfurization of Illinois Coal by In-Situ Preparation of Iron Sulfide Catalysts, Illinois Coal Development Board Fourth Annual Contractors' Technical Meeting, Champaign, Ill., Sep. 30-Oct. 2, 1986.

Webster, J. R. et al. (1985), Desulfurization of Illinois Coal by In-Situ Preparation of Iron Sulfide Catalysts III, Illinois Coal Development Board Third Annual Contractor' Technical Meeting, Champaign, Ill., Oct. 22-24.

Shiley, R. H. et al. (1984), Desulfurization of Illinois Coal by In-Situ Preparation of Iron Sulfide Cayalysts, Illinois Coal Research Board Second Annual Contractors' Technical Meeting, Champaign, Ill., Oct. 30-Nov. 1, 1984.

Warren, R. L. et al. (1987), Development of the Carbon Monoxide-Ethanol Desulfurization, Proceedings of the Second International Conference on Processing and Utilization of High Sulfur Coals, Carbondale, Ill., Sep. 28-Oct. 1, pp. 235-244.

Elliot, R. C. (Editor), 1978, Coal Desulfurization Prior to Combustion, Noyes Data Corporation Park Ridge, N.J., U.S.A., 1978.

Furimsky, E. et al. (1988), Characterization of Carbonaceous Solids by Oxygen Chemisorption, Fuel, 67, pp. 798-802.

Liotta, R. et al. (1983), Oxidative Weather of Illinois No. 6 Coal, Fuel, 62, pp. 781-791.

Smith, G. V. et al. (1987), Microbalance Reactor Studies of Coal Desulfurization with Carbon Monoxide, Ethanol, and Ethanol/Radical Initiator Mixtures, Proceedings of the Environmental Pollution Control and Hazardous Waste Management Conference, National Cheng Kung University, Tianan, Taiwan, Republic of China, pp. 83-87, Nov., 1987.

Snow, R. D., "Conversion of Coal Sulfur to Volatile Sulfur Compounds During Carbonization in Streams of Gases," *Industrial and Engineering Chemistry,* Aug. 1932, p. 903.

Morimoto, N. et al., "Pyrrhotites: Stoichiometric Compounds with Composition $Fe_{n-1}S_n$ ($n \geqq 8$)", *Science,* vol. 168, p. 964, May 22, 1970.

Attar, A., "Chemistry, Thermodynamics and Kinetics of Reactions in Sulfur in Coal-Gas Reactions: A Review", *Fuel,* vol. 57, p. 201, Apr., 1978.

Hinckley, C. C. et al., "Desulfurization of Coal by Reaction with Carbon Monoxide and Secondary Reactants," *Mineral Matters,* Jan. 1983.

(List continued on next page.)

*Primary Examiner*—Carl F. Dees

*Attorney, Agent, or Firm*—Willian Brinks Olds Hofer Gilson & Lione

[57] ABSTRACT

A process for desulfurizing carbonaceous material containing inorganic bound sulfur, organic bound sulfur, or conbinations thereof. The process comprises reacting the carbonaceous material at desulfurization conditions with a hydrogen source material in the presence of a reaction accelerator to enhance production and reactivity of atomic hydrogen supplied by the hydrogen source. The reaction is prefereably carried out in the presence of a flowing reaction medium which carries away hydrogen sulfide products and other volatile desulfurization products separating them from the carbonaceous material.

17 Claims, No Drawings

OTHER PUBLICATIONS

Hinckley, C. C. et al., "SIU Coal Desulfurization Research, Toward Compliance-Level Coals," vol. 7, No. 3, May, 1985.

*Illinois State Geological Survey Annual Report,* May 1986-Apr. 1987, Published Jun. 9, 1987.

Smith, G. V. et al., "Coal Desulfurization with Carbon Monoxide, Ethanol and Ethanol/Radical Initiator Mixtures," *Mineral Matters,* vol. 10, No. 2, Apr. 1988.

Webster, J. R. et al., "Desulfurization of Illinois Coal by In Situ Preparation of Iron Sulfide Catalysts," *Proceedings of the Second Annual Pittsburgh Coal Conference,* Pittsburgh, Pa., p. 138, Sep. 16, 1985.

Shiley, R. H. et al., "Design Principles for a Coal Desulfurization Process with Iron Sulfides as In Situ Catalysts," *Environmental Geology Notes,* 1986.

Webster, J. R. et al., "Development of the Carbon Monoxide-Ethanol Desulfurization Process," *Proceedings of the Third Annual Pittsburgh Coal Conference,* Pittsburgh, Pa., No. 29, Sep. 8, 1986.

Webster, J. R. et al., "Coal Desulfurization Using Ethanol," *4th Annual National Conference, Alcohol Fuels,* Kansas City, Mo., Aug. 19, 1986.

Hinckley, C. C. et al., "Carbonyl Sulfide/Carbon Chemistry," *United States Department of Energy Report,* Oct. 1986.

Final Technical Report, Dec. 15, 1982 through Aug. 31, 1986, "Desulfurization of Illinois Coal by In-Situ Preparation of Iron Sulfide Catalysts: Part III," submitted to Illinois Coal Development Board, Mar. 1987 revision.

Wu, L. et al., "Carbon Monoxide-Ethanol Desulfurization of Coal: A Preliminary Economic Overview," *Alcohol Fuels Mandate,* Jul. 28, 1987.

Warren, R. L. et al., "The Carbon Monoxide/Ethanol Desulfurization of High Sulfur Coal: A Technical Overview," *Alcohol Fuels Mandate,* Jul. 28, 1987.

DESULFURIZATION OF CARBONACEOUS MATERIALS

FIELD OF INVENTION

The present invention relates to the removal of sulfur from carbonaceous materials. Specifically, the present invention relates to desulfurization of carbonaceous materials containing inorganic bound sulfur, organic bound sulfur, and combinations thereof.

BACKGROUND OF THE INVENTION

The prior art contains many processes for desulfurizing carbonaceous materials such as coal, cokes, coal products, liquid crudes, and similar materials. These carbonaceous materials contain both inorganic bound and organic bound sulfur. One problem with many of these processes is that they are only capable of removing inorganic bound sulfur and are not very effective in removing organic bound sulfur.

Currently known processes which remove both inorganic and organic bound sulfur have various disadvantages. One problem is that these processes require multiple steps resulting in high operation cost. A second problem is that many of these processes rely on physical separation methods such as magnetic separation, flotation, and the like for removing inorganic bound sulfur. Physical separation techniques are inefficient and also result in higher operation cost.

Processes employing thermal and/or chemical means for removing inorganic bound sulfur also suffer from disadvantages. For example, these processes lower the heating value of the feedstock during sulfur removal. In addition, many of these processes are limited to particular feedstocks as they require the presence of pyrite or marcasite which is then converted to troilite which catalyzes the removal of organic bound sulfur.

In addition, desulfurization processes employing reactive gases such as carbon monoxide, oxygen, nitric oxide, and low carbon alcohols have also been disclosed. These methods however focus upon the desulfurization of only one particular variety of sulfur.

It is therefore an object of the present invention to provide an economical and effective process for desulfurizing carbonaceous materials containing either inorganic bound sulfur, organic bound sulfur, or both. It is a further object of the present invention to provide a process for desulfurizing carbonaceous materials containing both inorganic bound sulfur and organic bound sulfur in a single step. It is still a further object of the present invention to provide a process for desulfurizing carbonaceous materials without substantially depleting the heating value of the original feedstock. Desulfurization processes having these advantages will be readily recognized as an advance in the art and will meet with substantial commercial success.

SUMMARY OF THE INVENTION

In accordance with one embodiment of the present invention there is provided a process for desulfurizing carbonaceous material containing inorganic and/or organic bound sulfur. The process comprises reacting the carbonaceous material at desulfurization conditions with a hydrogen source material in the presence of a reaction accelerator. The desulfurization process is preferably carried out in a flowing reaction medium.

In accordance with another embodiment of the present invention there is provided a process for desulfurizing carbonaceous material containing inorganic and/or organic bound sulfur. The process comprises treating the carbonaceous material at a temperature of about 300° C. to about 500° C. and a pressure of about 100 psig to about 500 psig with an alcohol having between 1 and about 3 carbon atoms in the presence of a flowing gas medium comprising between about 0.1 to about 2.0 volume percent reaction accelerator.

In both of the above embodiments the reaction accelerator enhances production and reactivity of atomic hydrogen supplied by the hydrogen source material. Accordingly, inorganic bound sulfur and/or organic bound sulfur present in the carbonaceous material respectively react with the atomic hydrogen to produce hydrogen sulfide which is preferably carried away from the carbonaceous material by the flowing medium.

DETAILED DESCRIPTION OF PRESENTLY PREFERRED EMBODIMENTS

It has now been discovered that the removal of inorganic bound sulfur and organic bound sulfur from carbonaceous materials may be accomplished in a single desulfurization step. Inorganic and organic bound sulfur can be concurrently removed from carbonaceous materials by reacting the material with a hydrogen source in the presence of a reaction accelerator. The reaction accelerator enhances production of atomic hydrogen supplied by the hydrogen source. The reaction accelerator further enhances the reactivity of atomic hydrogen with the inorganic or organic bound sulfur to produce hydrogen sulfide. Under flowing reaction conditions, the hydrogen sulfide and other volatile desulfurization products are carried away and efficiently separated from the carbonaceous material.

The present invention provides many advantages over the prior art. For example, both inorganic and organic bound sulfur can be removed in a single step. A single step desulfurization process decreases operation and maintenance cost.

The present invention further may not require a sulfur containing catalyst such as troilite to enhance the removal of organic bound sulfur. Accordingly, the present invention is not necessarily limited to feedstocks containing troilite precursor materials such as pyrite or marcasite. In fact, the present invention may be employed with feedstocks which do not contain sulfur bearing inorganic materials. Thus, the present invention may be applied to carbonaceous materials containing only organic bound sulfur, only inorganic bound sulfur, or both organic and inorganic bound sulfur.

A still further advantage of the present invention is that the presence of the reaction accelerator allows the desulfurization process to be carried out at mild conditions. Thus more severe conditions such as that of pyrolysis and similar reactions are avoided.

The present invention provides a further advantage in that the need for oxidative removal of inorganic bound sulfur is eliminated. In the absence of oxidative sulfur removal, the high heating values present in the original feedstock are retained.

The present invention provides a still further advantage in that the resulting desulfurization product contains volatile components which may facilitate combustion. Further, under appropriate conditions a significant amount of high quality hydrocarbonaceous oil may also be obtained.

The above advantages are not to be construed as a limitation of the present invention the scope of which is defined in the appended claims. Accordingly, other advantages which are apparent in view of the specification are also contemplated.

Carbonaceous feedstock materials contemplated by the present invention include coal, char, cokes, and other coal and coal-like products. The carbonaceous material may be particulate, liquid, or a combination thereof.

The feedstock carbonaceous material may contain inorganic bound sulfur or organic bound sulfur. Thus feedstocks containing only inorganic bound sulfur or only organic bound sulfur may be employed. Thus a combination of inorganic and organic bound sulfur is not necessary to the present invention. Accordingly, the present invention may be employed with feedstocks comprising physically clean coals which do not contain inorganic bound sulfur. The present invention however may also be employed with carbonaceous materials containing commonly known iron-sulfur minerals such as pyrite, marcasite, pyrrhotite, troilite, and the like.

The hydrogen source material contemplated by the present invention includes any hydrogen containing compound which will readily become dehydrogenated in the presence of a reaction accelerator. Hydrogen source materials suitable for the present invention include but are not limited to hydrogen, alcohols having between 1 and about 3 carbons, hydrocarbons having between 1 and about 5 carbons, or a low molecular weight alicyclic compound such as tetralin.

Reaction accelerators contemplated by the present invention include any compound which enhances the dehydrogenation and thus production of atomic hydrogen from the hydrogen source material. Reaction accelerators contemplated further include those compounds which enhance the reactivity of atomic hydrogen with either inorganic bound sulfur and/or organic bound sulfur to produce hydrogen sulfide. Preferable reaction accelerators include low molecular weight compounds having the properties above such as oxygen and nitric oxide.

Preferably, the reaction is carried out in a flowing gas medium comprising oxygen, nitric oxide, or a combination thereof at a concentration of about 0.1 to about 2.0 volume percent. The flowing reaction medium provides at least three advantages. First, the flowing medium provides good control of the amount of reaction accelerator contacted with the sulfur containing carbonaceous material. Second, the flowing medium provides a carrier for hydrogen sulfide and other volatile desulfurization products separating them from the carbonaceous materials. Finally, the separation of hydrogen sulfide also prevents back reaction with the carbonaceous material which forms organic sulfur compounds.

As already noted the present invention allows desulfurization to be carried out at relatively mild desulfurization conditions. Preferably the desulfurization reaction is carried out at temperatures up to about 550° C. and pressures up to about 600 psig. Most preferably the desulfurization process is carried out in a temperature range of about 300° C. to about 500° C. and a pressure in the range of about 100 psig to about 500 psig.

Accordingly, the present invention allows standard commercial equipment such as batch or stationary bed pressure reactors to be employed. These reactors may be equipped with gas flow and back pressure apparatus when desired. In addition, continuous feed gas flow reactors as well as continuous feed fluidized bed reactors are also contemplated for use in the present invention.

In one embodiment, the desulfurization process of the present invention can be carried out in a single step in which both inorganic and organic bound sulfur is removed as a result of concurrent reaction sequences. In the first reaction sequence inorganic bound sulfur which is usually present as an iron sulfide is reacted with atomic hydrogen to produce hydrogen sulfide. The hydrogen sulfide product is preferably swept away by the flowing reaction medium separating it from the carbonaceous material. The reaction accelerator functions to enhance the production of atomic hydrogen from the hydrogen source material. The atomic hydrogen then reacts with the inorganic bound sulfur in the carbonaceous material to produce hydrogen sulfide. Thus in the present invention reduction of the sulfur bearing mineral species does not stop at an intermediate phase such as in the case of many prior art processes. Thus where pyrite or marcasite is present in the carbonaceous material reaction goes beyond the troilite phase and depending upon the reaction accelerator employed the sulfur bearing iron may be converted to iron in the free state or magnetite or other iron oxide.

In the second reaction sequence, organic bound sulfur is hydrogenated by the atomic hydrogen to produce hydrogen sulfide. As above, the presence of the reaction accelerator enhances the dehydrogenation of the hydrogen source material to produce atomic hydrogen. Hydrogen sulfide may be also carried away by the flowing reaction medium. The resulting clean product of these two reactions is of great commercial value.

By-products obtained from the process of the present invention depend upon hydrogen source material and reaction accelerator. In accordance with one embodiment, when ethyl alcohol is employed as the hydrogen source material, commercial by-products include high volatile products, oil, and acetaldehyde. In addition, since during the present desulfurization process only a portion of volatile matter is lost from the carbonaceous material, the sulfur free carbonaceous product is relatively high in volatility. And in the case of coal feedstock, the resulting product is a solid coal-like product containing significant concentrations of volatile matter which may aid in the subsequent combustion of the material. Of course, those skilled in the art will recognize that the concentrations of volatile matter are subject to reaction temperatures as well as the characteristics of the carbonaceous material being desulfurized.

In addition, significant amounts of oil can be generated and recovered from the desulfurization process of the present invention. Of course oil yields are also subject to reaction temperatures as well as the characteristics of the carbonaceous material being desulfurized. Finally, the hydrogen sulfide may be employed as a feed material to be reacted with sulfur dioxide in a Claus reaction to produce elemental sulfur.

Further, as already noted, sulfur containing catalysts are not necessary to the present invention. In many prior art desulfurization processes, sulfur containing catalysts such as troilite are employed to enhance the reactivity of thiophenes and like organic bound sulfur compounds. The presence of the reaction accelerator, however, sufficiently enhances the production and reactivity of atomic hydrogen supplied which hydrogenates organic bound sulfur to yield hydrogen sulfide. It is to be understood, however, that while not necessary, the presence of sulfur containing catalysts is not adverse to the present invention.

It has also been found that graphite or other layered structures such as clay may be employed as an optional catalyst for the production of atomic hydrogen from the hydrogen source material. These optional catalysts are preferably employed in the presence of an advanced deep physically clean coal or liquid carbonaceous material. In the case of coal, these optional catalysts enhance the removal of organic bound sulfur without significantly altering the ash content off the final product. Clay minerals contemplated by the present invention include layered-structural materials such as smectite (for example montmorillionite).

Those skilled in the art will recognize that the present desulfurization process may be improved through adjustments of feedstock size (in the case of particulate carbonaceous materials) and reaction medium pressure thereby enhancing contact between the solid or liquid and gaseous phase. Further, the reaction medium may contain in addition to the hydrogen source material and reaction accelerator inert gases such as argon and nitrogen.

While the present invention is preferably carried out in a single step, those skilled in the art will also recognize that where practicality dictates, the two reaction sequences required to remove inorganic bound sulfur and organic bound sulfur respectively may be carried out in two consecutive reactors or reactor trains employing variations in transport time, temperature and pressure.

The present invention is further described in the following examples. It is to be understood however that these examples are not to be construed as limiting the present invention, the scope of which it is defined in the appended claims.

EXAMPLES

Coal or other carbonaceous material is heated at 350° C. or higher temperature in a flowing gas stream comprising a hydrogen source and a low concentration (0.1 to 2.0%) of a reaction accelerator. The hydrogen source may be a low molecular weight alcohol ($C_1$–$C_3$), such as ethanol, or hydrocarbon ($C_1$–$C_5$), such as methane, pentane, or natural gas, or hydrogen. The reaction accelerator may be oxygen, nitric oxide or other similar species capable of abstracting a hydrogen atom from the hydrogen source molecule. Under these conditions, the principle sulfur containing product gas is $H_2S$, though OCS, sulfur dioxide or mercaptans may be generated. If pyrite is present, as in coal, Moessbauer spectra show that the pyrite is converted to a mixture of pyrrhotite and/or troilite, or pyrrhotites, troilite, and metallic iron depending on process conditions. At 420° C., the overall reaction rate of ethanol, present at 60 mm/Hg partial pressure in a He carrier stream, with pyrite is increased by 50% by the presence of 1.5% $O_2$ in the gas stream. The reaction rate is increased by 100% when NO is injected into the ethanol stream.

A coal sample containing pyrite can be treated with ethanol and NO reaction accelerators to remove both the organic and inorganic forms of sulfur in one step. In a typical experiment performed at 420° C. and using 50 microliter injections of NO at set intervals the sulfur level of a coal can be reduced by over 90 percent. The initial sulfur content of such a sample was 3.16%, after the ethanol/NO treatment the sulfur percentage was 0.26%. This level of sulfur reduction can only be achieved if both the organic and inorganic sulfur species are reduced simultaneously. Under these conditions, pyrite/marcasite in the coal was converted to free iron and a small amount of troilite.

In another experiment, coal containing pyrite which had been devolatilized at 400° C. was treated at 400° C. with ethanol and 2.0% oxygen. Weight loss data show that both pyrite/marcasite and organic sulfur components reacted simultaneously. The principal sulfur product gas was $H_2S$. Carbonyl sulfide and sulfur dioxide were also observed. Under these conditions, pyrite/marcasite in the coal was converted to magnetite or other iron oxide, and the desulfurization was essentially complete.

We claim:

1. A process for desulfurizing carbonaceous material containing inorganic bound sulfur, organic bound sulfur, or a combination thereof comprising reacting the carbonaceous material at desulfurization conditions with a hydrogen source material comprising an alcohol, a hydrocarbon, an alicyclic compound, hydrogen, or a combination thereof in the presence of a flowing gas medium comprising a reaction accelerator comprising oxygen, nitric oxide, or a combination thereof to enhance production and reactivity of atomic hydrogen supplied by said hydrogen source.

2. The process of claim 1 wherein the desulfurization conditions comprise a temperature in the range of about 300° C. to about 500° C. and a pressure in the range of about 100 psig to about 500 psig.

3. The process of claim 1 wherein the carbonaceous material comprises coal, cokes, coal products, liquid crudes, or combinations thereof.

4. The process of claim 1 further comprising adding an optional catalyst comprising a layered graphite or clay material.

5. The process of claim 1 wherein the hydrogen source material is selected from the group consisting of an alcohol having between about 1 to 3 carbon atoms, a hydrocarbon having between about 1 to 5 carbon atoms, tetralin and hydrogen.

6. The process of claim 1 wherein the flowing gas medium comprises between about 0.1 to about 2.0 volume percent reaction accelerator.

7. The process of claim 1 wherein the reaction accelerator comprises nitric oxide and sulfur bound to iron as pyrite or marcasite reacts with said atomic hydrogen formed from said nitric oxide to yield iron and hydrogen sulfide.

8. The process of claim 1 wherein the reaction accelerator comprises oxygen and sulfur bound to iron as pyrite or marcasite reacts with said atomic hydrogen formed from said oxygen to yield magnetite and hydrogen sulfide.

9. The process of claim 1 wherein organic bound sulfur is hydrogenated to form hydrogen sulfide.

10. A process for desulfurizing carbonaceous material containing inorganic bound sulfur, organic bound sulfur, or a combination thereof comprising treating the carbonaceous material at a temperature of about 300° C. to about 500° C. and a pressure of about 100 psig to about 500 psig with an alcohol having between 1 and about 3 carbon atoms and a flowing gaseous medium comprising about 0.1 to about 2.0 volume percent reaction accelerator comprising oxygen, nitric oxide, or a combination thereof to enhance production and reactivity of atomic hydrogen supplied by said alcohol, said inorganic bound sulfur and/or said organic bound sulfur reacting with said atomic hydrogen to produce hydrogen sulfide which is carried away from said carbonaceous material by said flowing medium.

11. The process of claim 10 further comprising adding an optional catalyst comprising a layered graphite or clay material.

12. The process of claim 10 wherein the carbonaceous material comprises coal, cokes, coal products, liquid crudes, or combinations thereof.

13. A process for desulfurizing carbonaceous material containing inorganic bound sulfur, organic bound sulfur, or a combination thereof comprising treating the carbonaceous material at a temperature of about 300° C. to about 500° C. and a pressure of about 100 psig to about 500 psig with a flowing gaseous medium comprising methane and a reaction accelerator comprising oxygen, nitric oxide, or a combination thereof to enhance production and reactivity of atomic hydrogen supplied to said methane, said inorganic bound sulfur and/or said organic bound sulfur reacting with said atomic hydrogen to produce hydrogen sulfide which is carried away from said carbonaceous material by said flowing medium.

14. The process of claim 13 further comprising adding an optional catalyst comprising a layered graphite or clay material.

15. The process of claim 13 wherein the carbonaceous material comprises coal, cokes, coal products, liquid crudes, or combinations thereof.

16. The process of claim 13 wherein said gaseous medium comprises natural gas.

17. The process of claim 13 wherein said gaseous medium comprises about 0.1 to about 2.0 volume percent reaction accelerator.

* * * * *